US008419500B2

(12) United States Patent
Morgan et al.

(10) Patent No.: US 8,419,500 B2
(45) Date of Patent: Apr. 16, 2013

(54) TOY VEHICLE FOR PICKING UP AND RELAYING TRACK

(75) Inventors: Barry Zellie Morgan, Stamford, CT (US); Matthew A. Lauderbach, Belford, NJ (US)

(73) Assignee: Mattel, Inc., El Segundo, CA (US)

( * ) Notice: Subject to any disclaimer, the term of this patent is extended or adjusted under 35 U.S.C. 154(b) by 307 days.

(21) Appl. No.: 12/650,723

(22) Filed: Dec. 31, 2009

(65) Prior Publication Data

US 2011/0065357 A1 Mar. 17, 2011

Related U.S. Application Data

(60) Provisional application No. 61/277,118, filed on Sep. 17, 2009.

(51) Int. Cl.
*A63H 19/02* (2006.01)

(52) U.S. Cl.
USPC ..... 446/467; 446/435; 446/444; 446/447; 238/10 E; 238/10 R; 238/10 F

(58) Field of Classification Search ..... 446/137, 446/489, 444, 446, 447, 451, 457, 467, 470; 238/10 E, 10 F, 10 R
See application file for complete search history.

(56) References Cited

U.S. PATENT DOCUMENTS

| | | | | | |
|---|---|---|---|---|---|
| 417,015 | A | * | 12/1889 | Gause | 446/444 |
| 2,696,791 | A | * | 12/1954 | Boulard | 104/3 |
| 3,224,141 | A | * | 12/1965 | Borak | 446/137 |
| 3,264,782 | A | | 8/1966 | Glass et al. | |
| 3,427,746 | A | * | 2/1969 | Jacobs | 446/433 |
| 3,477,172 | A | | 11/1969 | Polewski | |
| 3,611,632 | A | * | 10/1971 | Smith | 446/229 |
| 3,664,678 | A | * | 5/1972 | Van Der Meide | 280/47.2 |
| 3,688,436 | A | * | 9/1972 | Wakimura | 104/307 |
| 4,710,149 | A | * | 12/1987 | Prusman | 446/476 |
| 5,085,610 | A | | 2/1992 | Engel et al. | |
| 5,782,377 | A | | 7/1998 | Fassman | |
| 6,106,356 | A | | 8/2000 | Trageser | |
| 6,554,681 | B1 | * | 4/2003 | Tammera | 446/288 |
| 2007/0259600 | A1 | | 11/2007 | Bedford et al. | |

* cited by examiner

*Primary Examiner* — Gene Kim
*Assistant Examiner* — John E Simms, Jr.
(74) *Attorney, Agent, or Firm* — Panitch Schwarze Belisario & Nadel LLP

(57) ABSTRACT

A toy vehicle includes a main body assembly supported for movement on wheels and having opposing right and left lateral sides, opposing front and rear ends, and opposing top and bottom sides extending between the lateral sides and the ends. The combined opposing right and left lateral sides and opposing top and bottom sides of the main body assembly define a slot that extends through the toy vehicle. An arm is provided for lifting at least one track segment from a level below the main body assembly up and into the slot while one or more other propulsion elements are provided in or around the slot to engage and move the one track segment from the one end of the vehicle entirely through the main body assembly along the slot and out the opposing end of the vehicle.

18 Claims, 11 Drawing Sheets

TOY VEHICLE FOR PICKING UP AND RELAYING TRACK

CROSS-REFERENCE TO RELATED APPLICATIONS

The present application claims the benefit of U.S. Provisional Patent Application No. 61/277,118, filed on Sep. 17, 2009 and entitled "TOY VEHICLE FOR PICKING UP AND RELAYING TRACK," which is herein incorporated by reference in its entirety.

BACKGROUND OF THE INVENTION

The present invention relates generally to toy vehicles and, more particularly, to toy vehicles configured for picking up and relaying track over which the toy vehicle moves and configured for moving in at least two separate and distinct modes and/or travel paths.

Toy vehicles are generally known. Consumers today, especially those that play with dynamic toys, such as remote-controlled toy vehicles, desire new and unique features, motion and/or maneuvers. A toy vehicle having unique features or motion often engages the consumers attention for a longer period of time and has enhanced play value.

BRIEF SUMMARY OF THE INVENTION

Briefly stated, the present invention is directed to a toy vehicle including a main body assembly having opposing right and left lateral sides, opposing front and rear ends, and opposing top and bottom sides extending between the lateral sides and the ends. The combined opposing right and left lateral sides and opposing top and bottom sides of the main body assembly define a slot that extends through the toy vehicle. The toy vehicle further includes means for lifting at least one track segment from a level below the main body assembly up and into the slot and moving the at least one track segment entirely through the main body along the slot from one end of the toy vehicle to the opposing end of the toy vehicle.

In yet another aspect, the present invention is directed to a method of operating a toy vehicle. The method includes propelling the toy vehicle in a first direction over at least one track segment, picking up at least an end of the at least one track segment, passing the at least one track segment longitudinally through the toy vehicle from the one end to an opposite end of the toy vehicle, and relaying the at least one track segment at an opposite end of the toy vehicle.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
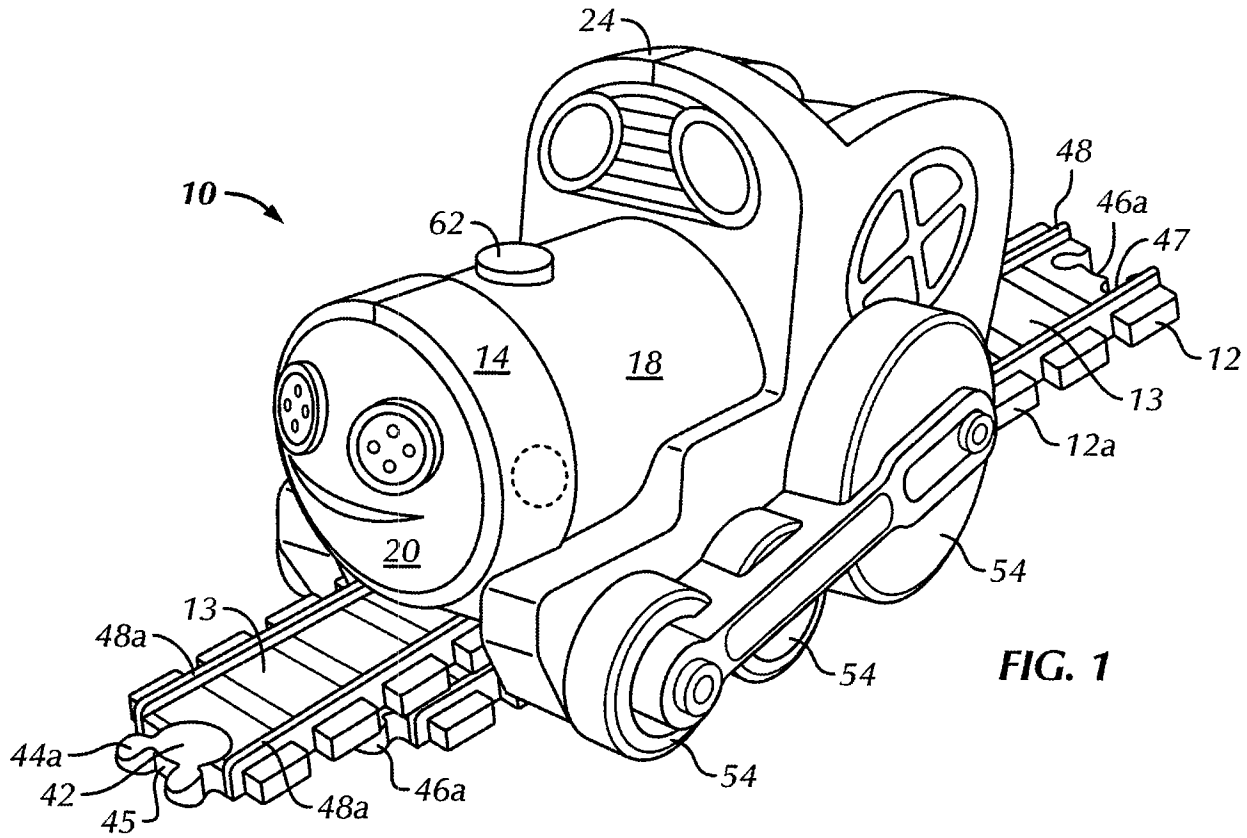
FIG. 1 is a front left perspective view of a toy vehicle and a preferred embodiment of various track segments in accordance with the present invention, wherein the toy vehicle is shown in a first or "magic" operational configuration or mode.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the toy vehicle, and designated parts thereof, in accordance with the present invention. Unless specifically set forth herein, the terms "a," "an" and "the" are not limited to one element but instead should be read as meaning "at least one." The terminology includes the words noted above, derivatives thereof and words of similar import.

Figure 2A:
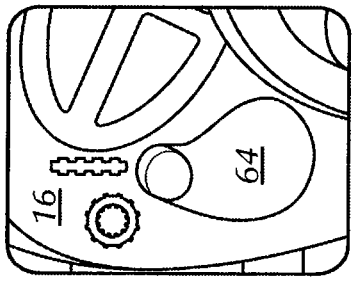
FIG. 2A is a magnified portion of the toy vehicle shown in FIG. 2.
Figure 3:
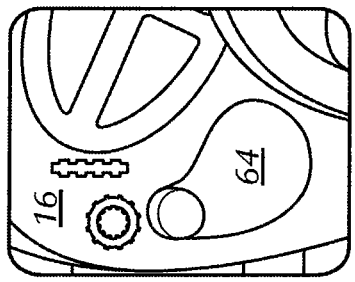
FIG. 3 is a magnified portion of the toy vehicle shown in FIG. 2, wherein the toy vehicle is shown in a second or "classic" operational configuration or mode.

Referring to the drawings in detail, wherein like numerals indicate like elements throughout, there is shown in FIGS. 1-14B a toy vehicle, generally designated 10, in accordance with a preferred embodiment of the present invention. Preferably, the toy vehicle 10 is configured to pick up and relay at least one track segment or section 12 over which the toy vehicle 10 moves. Further, the toy vehicle 10 is preferably configured to operate in a distinct first or "magic" operational configuration or mode (FIGS. 1, 2 and 2A) and a distinct second or "classic" operational configuration or mode (FIG. 3). Alternatively, the toy vehicle 10 may be capable of only one of the above features. Although reference herein is made specifically to a toy vehicle 10 in the form of a self-propelled train or locomotive, it is understood by those skilled in the art that the specific structural arrangements and methods described herein may be employed in virtually any type of toy vehicle, such as an automobile, truck, trolley car, subway car, or the like.

Figure 2:
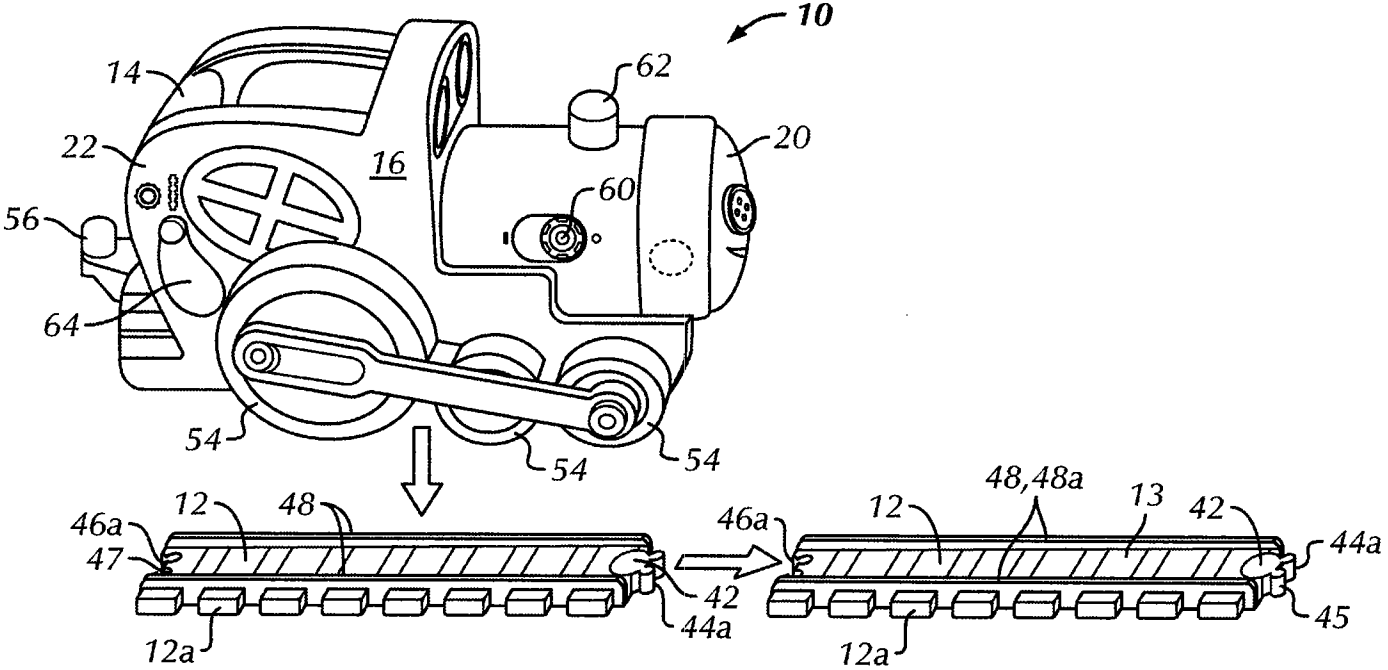
FIG. 2 is a right side perspective view of the toy vehicle and various track segments shown in FIG. 1, wherein the toy vehicle is shown in the first mode.
Figure 6:
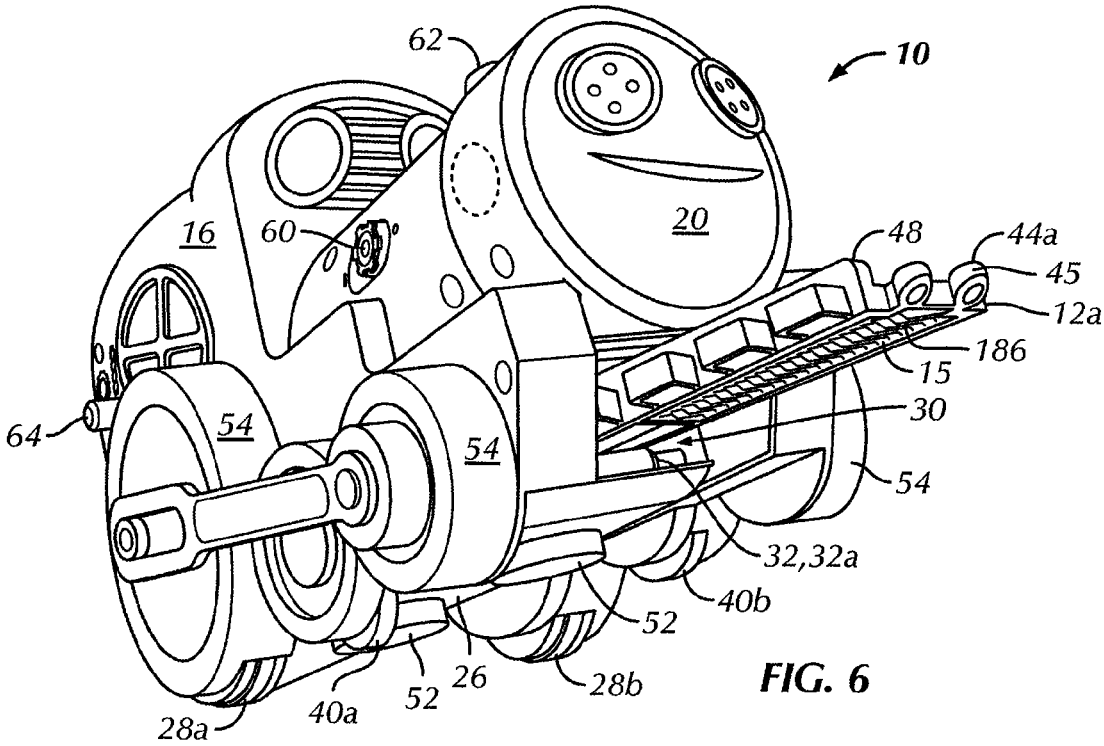
FIG. 6 is a bottom front perspective view of the toy vehicle shown in FIG. 5, with a portion of the first embodiment of the track segment shown within a portion of the toy vehicle.

In the magic mode, the toy vehicle 10 preferably picks up and relays at least one track segment 12 as the toy vehicle 10 moves generally straight in a first or forward direction or in an opposite second or reverse direction, as described in detail below. Specifically, as seen in FIGS. 1, 2 and 6, it is preferred that in the magic mode the at least one track segment 12 is moved or propelled entirely through or within the toy vehicle 10 while the toy vehicle 10 is moving or traveling in the same direction as the at least one track segment 12 is propelled (i.e., forward direction). In the classic mode, the toy vehicle 10 preferably moves in a generally circular or ovular fashion in either the first or second directions, without picking up and relaying a track segment 12, as described in detail below. However, in the classic mode, the toy vehicle 10 is preferably capable of moving in any direction defined by two or more track segments 12, such as a curvilinear direction or a direction in the shape of an "S." It is understood by those skilled in the art that the toy vehicle 10 is capable of moving without the use of one or more track segments 12, such as directly on or across a table top, floor, the ground or other track support surface, for example, with rotation toy vehicle 10 wheels powering the other parts of the toy vehicle's mechanism.

Preferably, power is supplied to the toy vehicle 10 by one or more reusable or disposable batteries (not shown) that that are removably enclosed within a battery housing 90 (FIG. 11) of the toy vehicle 10. However, the toy vehicle 10 may be powered by virtually any mechanism or source, such as by a power cord (not shown) designed to operatively engage a conventional electrical outlet or by solar power, for example. Furthermore, the toy vehicle 10 may incorporate a winding mechanism (not shown), for example, that when initiated or wound by a user releases user-generated and/or stored energy to propel the toy vehicle 10 and/or designated parts thereof. Alternatively, the toy vehicle 10 may simply require a user to physically move the toy vehicle 10 across the at least one track segment 12 or directly on the track support surface, for example, with rotation of the toy vehicle's wheels powering other parts of the track relaying mechanism.

Referring to FIGS. 1, 2, 3 and 6, the at least one track segment 12 preferably has a first embodiment comprised of at least one but preferably a pair of generally identical, separable and generally straight (linear) track segments 12*a* (FIGS. 1, 2 and 6) and a second or alternative embodiment comprised of at least one but preferably several (e.g., eight) generally identical, separable and generally curved (arcuate) track segments (not shown). In the preferred embodiment, at least one of the straight track segments 12*a* allows the toy vehicle 10 to operate in the magic mode and the several separable curved track segments, which in the preferred embodiment form a closed circular or ovular track pattern, allows the toy vehicle 10 to operate in the classic mode. It is understood that the size and shape of the track segments 12 may be modified. For example, a single unitary closed circuit (e.g., circular or ovular) track pattern can be provided for the toy vehicle 10 to operate in the classic mode. In addition, any combination of straight and curved track segments 12 may be combined to form a generally limitless number of distinct and/or unique track patterns for the toy vehicle 10 to travel over and/or on.

Each track segment 12 preferably includes a first or top surface 13 that supports, engages and/or faces at least a portion of the toy vehicle 10 when the toy vehicle 10 is being driven over the track segment. Further, each track segment 12 preferably includes an opposing second or bottom surface 15 (FIG. 6) generally in facing engagement with the ground, floor or other track support surface during use of the track segment 12 and the toy vehicle 10. The bottom surface 15 of each track segment 12 may include a grip member 186 (FIG. 6), preferably formed a relatively soft or malleable polymeric material, to increase the friction between each track segment 12 and the track support surface to prevent inadvertent sliding or movement of the track segment 12 with respect to the track support surface.

A first end 44*a* of each track segment 12 preferably includes a magnet 42 therein or thereon. In the preferred embodiment, the magnet 42 is located within or is enclosed by the first end 44*a* of each track segment 12. Further, each track segment 12 may include at least one rail 48 that extends upwardly from a remainder of the top surface 13 thereof. In the preferred embodiment, each straight track segment 12*a* includes two spaced-apart rails 48*a* that extend generally parallel to a longitudinal axis of each straight track segment 12*a* and each curved track segment includes two spaced-apart rails (not shown) that are curved to generally match the arcuate shape of the curved track segment. It is understood by those skilled in the art that the toy vehicle 10 is capable of moving directly on or across a track segment 12 that is void of any rails 48 or that includes more than two rails 48, as well as moving over a track segment spanning the track segment rather than running along the top surface.

As seen in FIGS. 1, 2 and 6, the first end 44*a* of each track segment 12 is preferably sized and shaped to form a male-type connector 45 and an opposing second end 46*a* of each track segment 12 is preferably sized and shaped to form a female-type connector 47. In the preferred embodiment, the male-type connector 45 is in the shape of a silhouette of the head of a Mickey Mouse® character and the female-type connector 47 includes a cut-out that is sized and shaped to receive the male-type connector 45 of an opposing first end 44*a* of one of the track segments 12. However, the size and shape of each connector 45, 47 may be modified. Further, it is understood by those skilled in the art that the track segments 12 may include virtually any type of connector, such as a tongue-and-groove connection or slot-and-pin connection, for example.

Referring again to FIGS. 1-14B, the toy vehicle 10 preferably includes a main body assembly 14 generally formed of a first or right half 68 (FIG. 10), which defines a first or right lateral side 16 (FIGS. 1-6), and an opposing second or left half 70 (FIG. 11), which defines an opposing second or left lateral side 18 (FIGS. 1 and 4). The main body assembly 14 further preferably includes a first or front end 20 and an opposing second or rear end 22. In addition, the main body assembly 14 preferably includes a third or top side 24 and an opposing fourth or bottom side 26. The top and bottom sides 24, 26 preferably extend between the lateral sides 16, 18 and the ends 20, 22.

Figure 7:
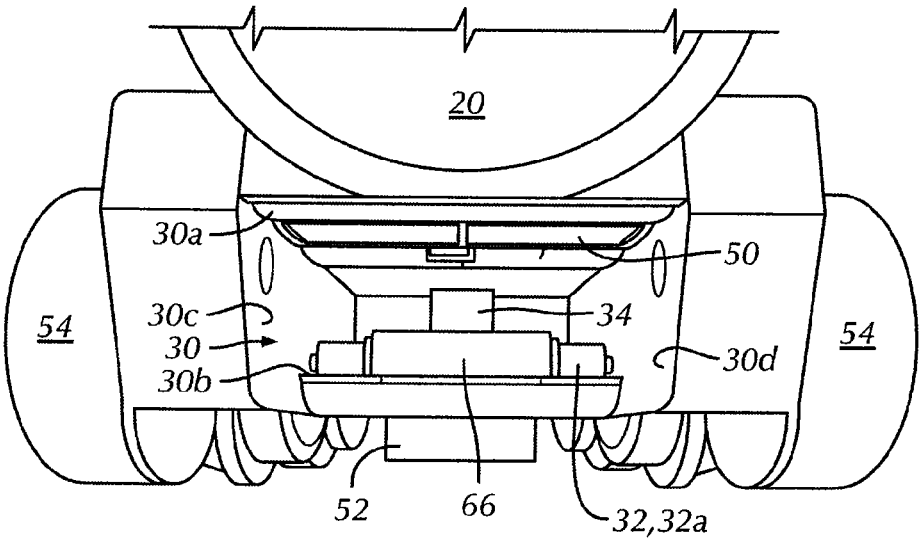
FIG. 7 is a magnified front perspective of a portion of the toy vehicle shown in FIG. 5.

In the preferred embodiment, the combined opposing right and left lateral sides 16, 18 and the opposing top and bottom sides 24, 26 of the main body assembly 14 preferably define a slot 30 (FIGS. 6-9) that extends through at least a portion of the toy vehicle 10. Specifically, it is preferred that the slot 30 defines an opening or passageway that generally extends completely through the toy vehicle 10 from the front end 20 to the rear end 22 and generally parallel to a longitudinal axis thereof. Specifically, as seen in FIG. 7, the slot 30 has a first or top surface 30*a*, an opposing second or bottom surface 30*b*, a third or right sidewall 30*c* and an opposing fourth or left sidewall 30*d*. The top and bottom surfaces 30*a*, 30*b* preferably extend generally perpendicularly to both the right and left sidewalls 30*c*, 30*d*, but the slot 30 is not limited to such a configuration. Further, the slot 30 is preferably sized and shaped to receive and pass at least one entire straight track segment 12*a* therethrough. However, it is understood that the size and shape of the slot 30 may be modified to receive a curved track segment therethrough, such that the toy vehicle 10 could operate in the magic mode using at least one curved track segment.

Figure 5:
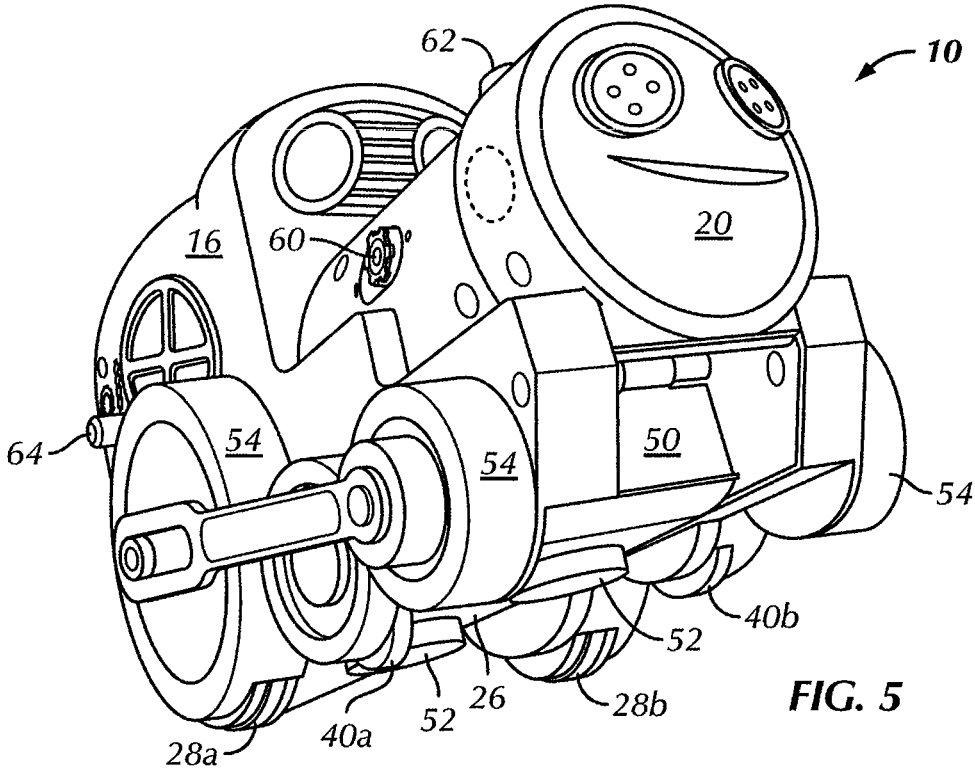
FIG. 5 is a bottom front perspective view of the toy vehicle shown in FIGS. 1 and 2.

As seen in FIG. 5, the toy vehicle 10 may include a door 50 that is preferably pivotably attached to the main body assembly 14 and generally closes a front end of the slot 30. Specifically, gravity preferably biases the door 50 in a first or closed position (FIG. 5) when the toy vehicle 10 is placed upright on the track support surface (FIG. 1) such that the front end of the slot 30 is generally blocked or closed. The door 50 is preferably pivotable between the first or closed position (FIG. 5) to an opposing second or open position (FIGS. 6 and 7). In operation of the preferred embodiment, and as described in detail below, as at least one straight track segment 12*a* is moved through the slot 30, a leading end, such as the first end 44*a*, of the straight track segment 12*a* directly contacts a rearward-facing side of the door 50 and forces the door 50 from the closed position to the open position such that the straight track segment 12*a* can pass completely through the slot 30. Once a trailing end, such as the second end 44*a* of the straight track segment 12*a* passes beyond the door 50, the door 50 swings back to the closed position. The door 50 is designed to provide an aesthetically-pleasing appearance to the front end 20 of the main body assembly 14 and/or hide the slot 30 when a straight track segment 12*a* is not passing through the slot 30 and/or when the toy vehicle 10 is in the classic mode.

As seen in FIGS. 4-9, in the preferred embodiment at least one and preferably two spaced-apart positioners 52 preferably extend downwardly beyond the bottom side 26 of the main body assembly 14. In the preferred embodiment, each positioner 52 is generally centrally-laterally located on the bottom side 26 of the main body assembly 14 with respect to the right and left lateral sides 16, 18. Each positioner 50 is preferably rotatable with respect to the bottom side 26 and is preferably sized and shaped to generally fit between the rails 48 of both the straight and curved track segments 12. Specifically, a diameter of each positioner 50 is preferably slightly less than a distance between interior surfaces of two spaced-apart rails 48 of a track segment 12, as measured generally perpendicularly to the longitudinal axis of the track segment 12 and the rails 48. Therefore, each positioner 50 encourages proper positioning of each track segment 12 with respect to the toy vehicle 10 by centering the toy vehicle 10 over the track segment 12. However, it is understood by those skill in the art that the toy vehicle 10 is not limited to the inclusion of one or more positioners 52.

Referring to FIGS. 4-6, 8-10 and 12-14, the toy vehicle 10 preferably includes a pair of driven wheels 28*a*, 28*b* supported for rotation from the main body assembly 14 proximal the opposing right and left lateral sides 16, 18. The pair of driven wheels 28*a*, 28*b* are preferably sized and shaped to rotate generally adjacent to (i.e., span) or across (i.e., on) the top surface 13 of the at least one track segment 12 and propel the toy vehicle 10 in either the first or second direction. In the embodiment where the pair of driven wheels 28*a*, 28*b*, at least a portion of each wheel 28*a*, 28*b* extends below the main body assembly 14 and the slot 30. Specifically, during operation of the preferred embodiment, the driven wheels 28*a*, 28*b* rotate directly on the track support surface, while the rails 48 of either track segment 12 pass through a gap located between an interior surface of each driven wheel 28*a*, 28*b* and an exterior surface of each positioner 52.

Further, the toy vehicle 10 preferably includes a pair of support wheels 40*a*, 40*b* supported for rotation from the main body assembly 14 proximal the opposing right and left lateral sides 16, 18. The pair of support wheels 40*a*, 40*b* are preferably sized and shaped to rotate adjacent to (i.e., span) or across (i.e., on) the top surface 13 of the at least one track segment 12 similar to the pair of driven wheels 28*a*, 28*b*. However, in the preferred embodiment, the support wheels 40*a*, 40*b* freely rotate and are not driven. Of course, the support wheels 40*a*, 40*b* may be driven or may be designed to pivot for steering purposes, if such functionality is deemed desirable. In the preferred embodiment, ornamental wheels 54 (FIGS. 1-10) are located on each lateral side 16, 18 of the main body assembly 14 proximate the bottom side 26 thereof. However, it is understood that these ornamental wheels 54 are not necessary to the functional features of the toy vehicle 10 described herein and such may be eliminated or modified in size and shape if deemed desirable.

Referring to FIGS. 2, 4, 8, 9 and 10, a rear end 22 of the main body assembly 14 may include a hitch 56 that extends outwardly therefrom. If provided, the hitch 56 is preferably sized and shaped to engage a least a portion of a trailing car (not shown) that may be towed by the toy vehicle 10 when the toy vehicle 10 is operating in the classic mode.

As seen in FIGS. 1-6 and 8-11 and as described in detail below, the main body assembly 14 preferably includes an ON/OFF switch or button 60, a depressible start button or switch 62, and a movable or slidable mode switch or button 64. Specifically, in the presently preferred embodiment, sliding or depressing the mode switch 64 to a first or right position (FIG. 2A) places the toy vehicle 10 in the magic mode and sliding or depressing the mode switch 64 to a second or left position (FIG. 3) places the toy vehicle 10 in the classic mode. In the preferred embodiment, the straight and curved track symbols shown above the mode switch 64 in FIGS. 2, 2A and 3 are designed to give the user a visual indication of the current operational mode of the toy vehicle 10. When the ON/OFF switch 60 is slid or depressed to the ON position (FIG. 2), the batteries are preferably operatively connected to a motor 38 (FIGS. 11-14) of the toy vehicle 10. Finally, when the start button 62 is depressed, a switch (not shown) within the toy vehicle 10 is preferably closed and the toy vehicle 10 beings to move or travel, preferably for a predetermined period of time. Once the predetermined time has elapsed, the switch is preferably opened, such that power is no longer supplied to the toy vehicle 10 and movement of the toy vehicle 10 ceases.

In the preferred embodiment, the toy vehicle 10 includes means for lifting the at least one track segment 12 from a level below the main body assembly 14 up and into the slot 30 and moving the at least one track segment 12 entirely through the main body assembly 14 along the slot 30 from the one end 20, 22 of the toy vehicle 10 to the other end 22, 20 of the toy vehicle 10. Preferably, the means for lifting and moving that at least one track segment 12 generally includes at least one rotating or reciprocating member or track segment propulsion element, preferably a roller or spindle 32 (see FIGS. 6-9), positioned within the slot 30 and at least one movable arm or lever 34 (see FIGS. 4, 8, 9 and 12-14), as described in detail below. As described in detail below, the arm 34 is preferably coupled with the at least one roller 32 for selective operation of the arm 34 with the roller 32. Further, the pair of driven wheels 28*a*, 29*b*, the arm 34 and the at least one roller 32 are operatively coupled together for simultaneous operation.

Referring to FIGS. 6-9, the toy vehicle 10 preferably includes the at least one roller 32 located within the main body assembly 14 and extending axially in a direction generally between the lateral sides 16, 18 thereof. In the preferred embodiment, the at least one roller 32 is generally cylindrical in shape and extends generally perpendicular to the longitudinal axis of the slot 30 entirely across the slot 30 proximate and/or within the bottom surface 30*d* of the slot 30. As described in detail below, the roller 32 is preferably operatively connected to the motor 38 and is rotated in a clockwise direction, when viewing the toy vehicle 10 from the right lateral side 16 thereof, by the motor 38. In operation, the roller 32 is capable of propelling the entire at least one straight track segment 12*a* completely through the slot 30. Further, the at least one roller 32 is preferably includes a gripping member 66 (FIGS. 7 and 8) that surrounds at least a portion of the at least one roller 32. The gripping member 66 provides increased friction between the at least one straight track segment 12*a* and the at least one roller 32. However, the toy vehicle 10 is not limited to the roller 32 or the inclusion of the gripping member 66.

In the preferred embodiment, at least two spaced-apart rollers 32 are located within the main body assembly 14 and are each operatively connected to the motor 38 to rotate. Each roller 32 extends axially in a direction generally perpendicular to the longitudinal axis of the slot 30 and generally between the lateral sides 16, 18 of the main body assembly 14. Specifically, a first or front roller 32*a* is preferably located proximate the front end 20 of the main body assembly 14 and a second or rear roller 32*b* is proximate the rear end 22 of the main body assembly 14. The combination of two rollers 32*a*, 32*b* within the slot 30 and/or main body assembly 14 generally improves the speed and/or efficiency of moving at least one straight track segment 12*a* through the slot 30. However, it is understood that the toy vehicle 10 is not limited to the inclusion of one or more rollers 32, as a variety of rotating or reciprocating mechanisms may be employed, including but not limited to conveyor belt(s), reciprocating rack(s) or pawl (s), opposed sidewall wheels, rollers, or the like (none shown), to propel the at least one track segment 12 through the slot 30. For example, a conveyor belt may extend generally the entire length of the slot 30 from the rear end 22 to the front end 20 of the toy vehicle 10 to propel the at least one straight track segment 12*a* with respect to the toy vehicle 10.

Figure 4:
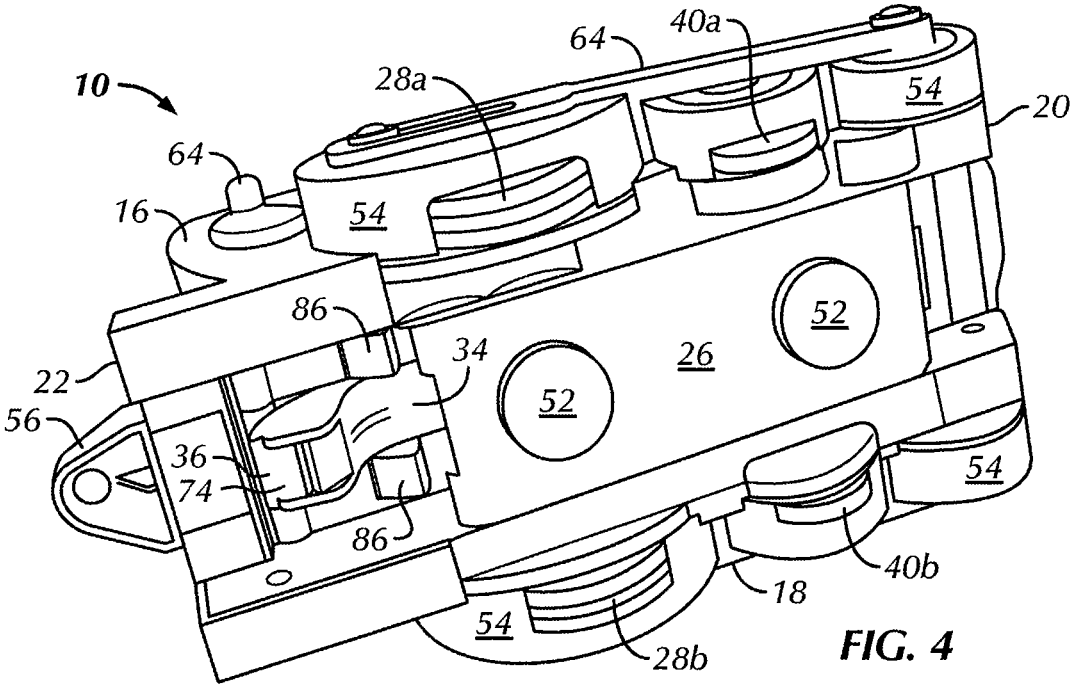
FIG. 4 is a bottom perspective view of the toy vehicle shown in FIGS. 1 and 2.
Figure 8:
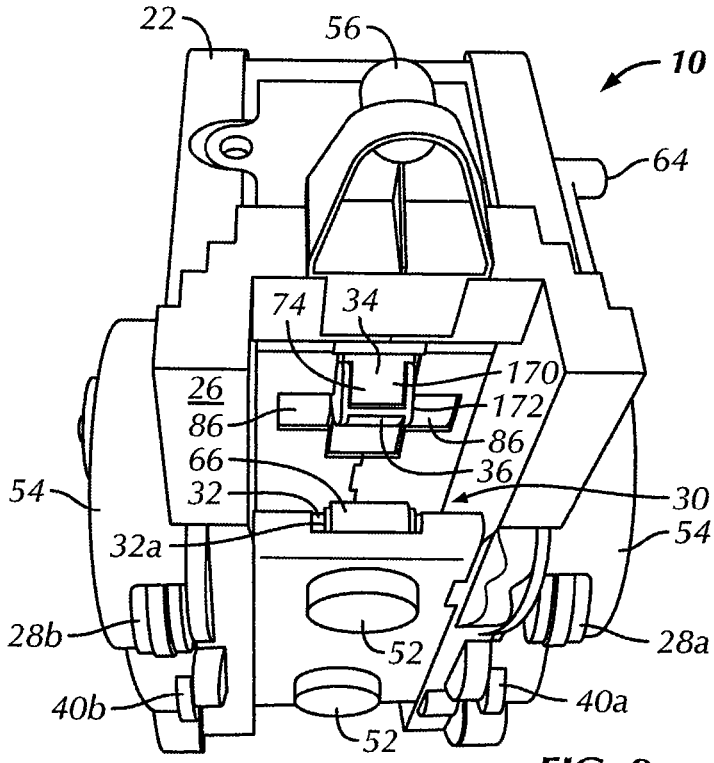
FIG. 8 is a bottom rear perspective view of the toy vehicle shown in the prior figures, wherein the toy vehicle is shown in the second mode and a pivotable arm of the toy vehicle is shown in a first or raised position.
Figure 9:
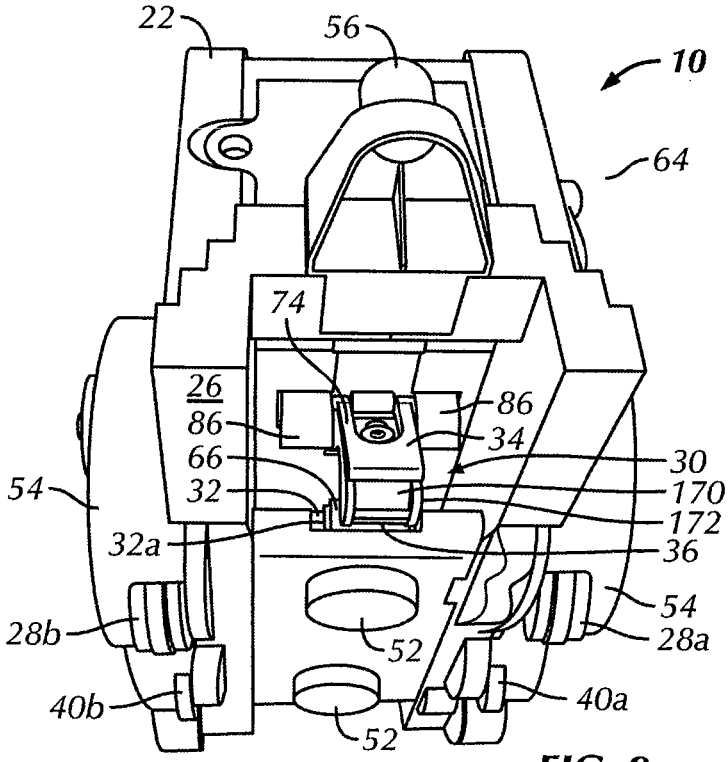
FIG. 9 is a bottom rear perspective view of the toy vehicle shown in the prior figures, wherein the toy vehicle is shown in the first mode and the pivotable arm is shown in an opposite or lowered position.
Figure 12:
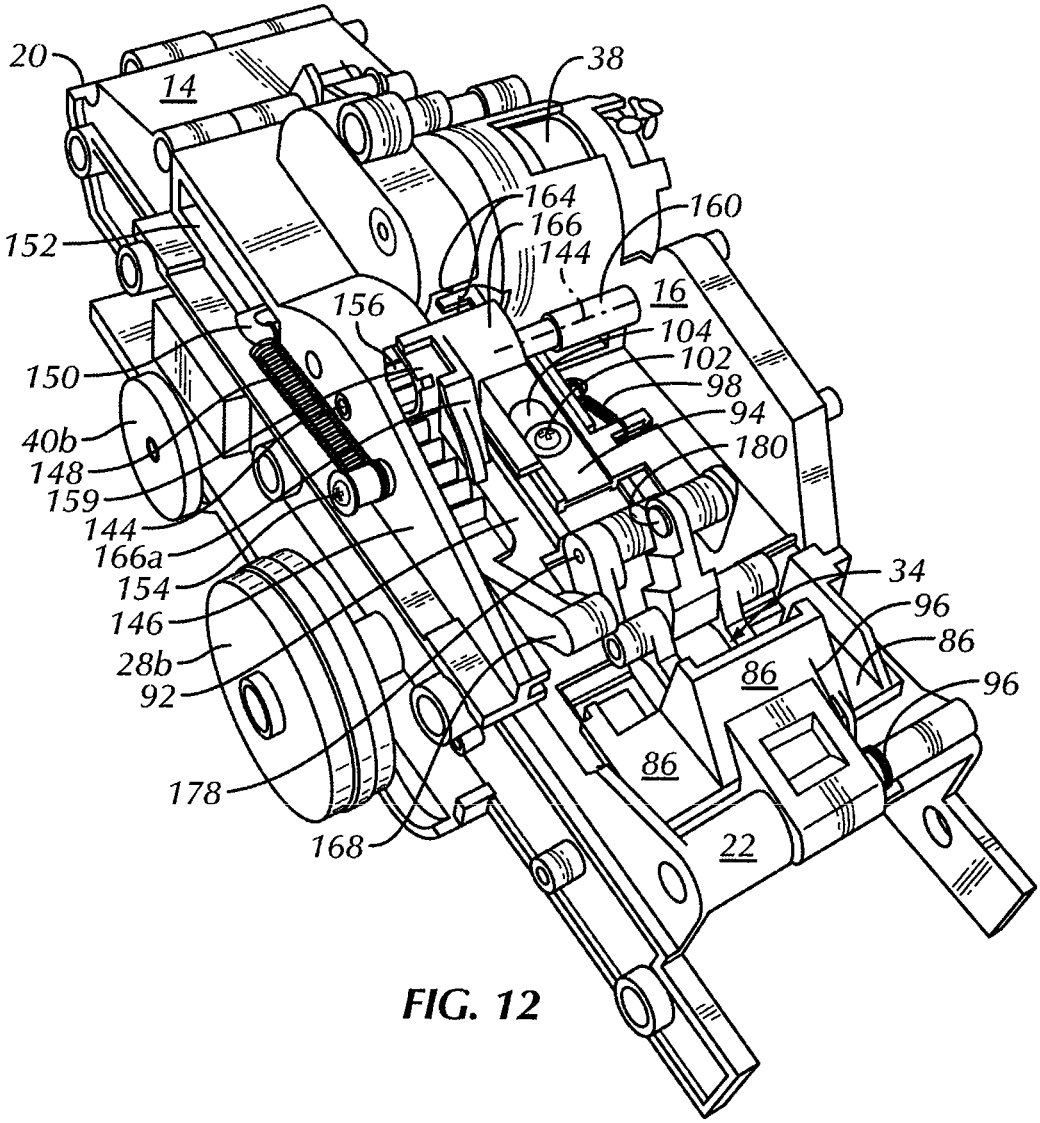
FIG. 12 is a top rear perspective of the interior of the toy vehicle shown in the prior figures, with various portions of the toy vehicle forming an outer body or shell removed for clarity and with the pivotable arm of the toy vehicle shown in the lowered position.
Figure 13:
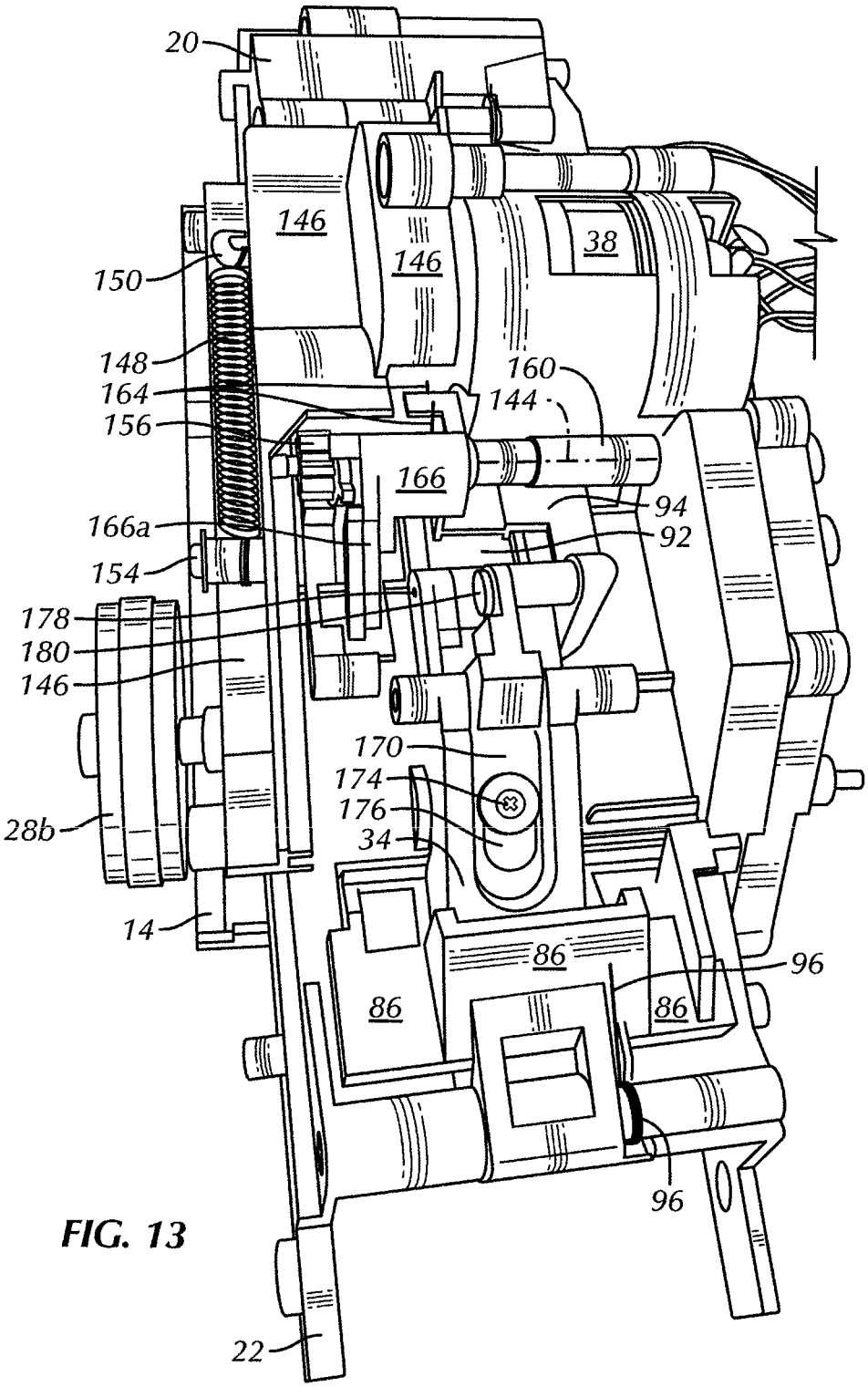
FIG. 13 is a top rear perspective of the interior of the toy vehicle shown in the prior figures, with outer shell portions of the toy vehicle body removed for clarity and with the pivotable arm of the toy vehicle shown in the raised position.

Referring to FIGS. 4, 8, 9 and 12-14, the toy vehicle 10 preferably includes the arm 34 that is movably supported from the main assembly 14. The arm 34 is essentially movable by a rack and rocker combination, as described in detail below. In the preferred embodiment, the arm 34 is generally arcuate in shape (when viewed from the side) and generally is formed of an inner portion 170 that is preferably movable a predetermined and preferably slight distance with respect to an outer portion 172. The inner portion 170 preferably rests in a groove or channel (see FIGS. 8 and 9) defined by interior surfaces of the outer portion 172. Specifically, as shown in FIG. 13, a pin or screw 174 generally extends upwardly from a lateral mid-point of the outer portion 172 and preferably fits within at least one slot or groove 176 of the inner portion 170 to limit the range of motion of the inner portion 170 with respect to the outer portion 172. Further, the inner portion 170 preferably includes a generally flat or planar end face 74 (FIGS. 4, 8 and 9). The end face 74 of the arm 34 preferably includes a magnet 36 therein or thereon for engaging at least a portion of the magnet 42 of the at least one track segment 12.

The arm 34, which is preferably spring-biased, but could be gravity-biased, to a first or lowered position (FIG. 9), is preferably operatively connected to the mode switch 64. Thus, movement of the mode switch 64 preferably moves or pivots the arm 34 between the lowered position (FIGS. 9 and 12) and an opposite or raised position (FIGS. 8 and 13). In the lowered position (FIGS. 9 and 12) (i.e., magic mode), the arm 32 is capable of engaging at least a portion, such as end 44*a*, 46*a*, of the at least one track segment 12 proximal one end 20, 22 of the toy vehicle 10 and lifting the portion of the at least one track segment 12 into the slot 30 and into operative engagement with the at least one roller 32 or other track segment propulsion element. Specifically, in the lowered position (FIG. 9), the magnet 36 of the arm 32 can magnetically engage the magnet 42 of the at least one track segment 12. In the raised position (FIGS. 8 and 13) (i.e., classic mode), the magnet 36 of the arm 34 avoids engagement with the magnet 42 of the at least one track segment 12. In the preferred embodiment, the arm 34 is located proximate the rear end 22 of the main body assembly 14, but it is understood by those skilled in the art that the arm 34 may be located at the front end 20 of the main body assembly 14 and the corresponding structure may be flipped or reversed as described herein, if the toy vehicle 10 is designed to move in the second or reverse direction.

Figure 10:
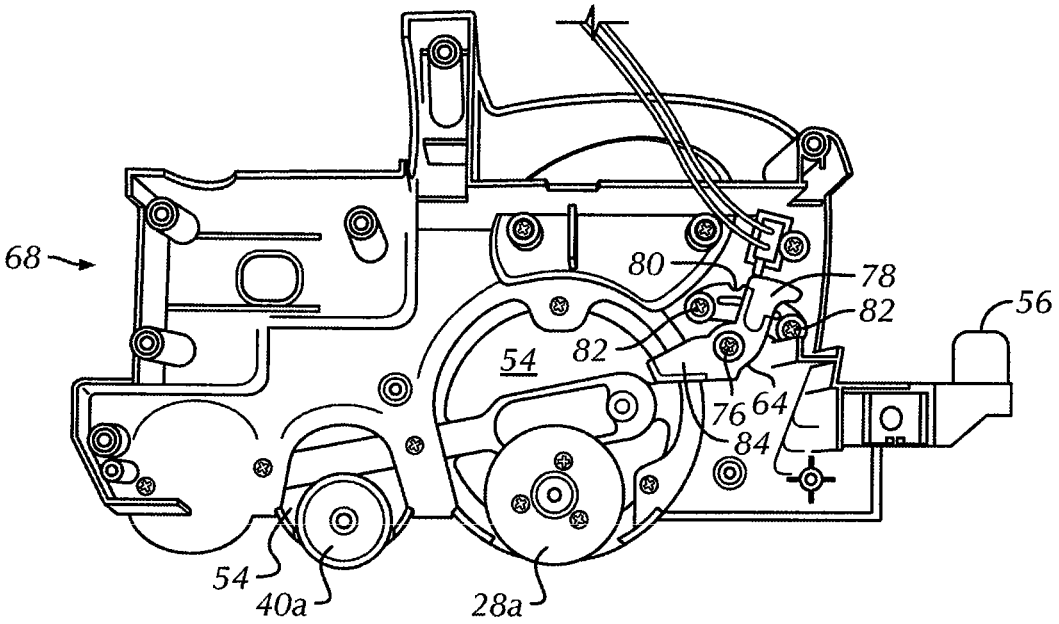
FIG. 10 is an elevation view of a portion of a chassis of the toy vehicle shown in the prior figures.

Specifically, as seen in FIG. 10, the mode switch 64 is preferably pivotable about a generally horizontally-extending pin 76 that extends through at least a portion of the right half 68 of the main body assembly 14. An extension or portion (not shown) of an upper half 78 of the mode switch 64 is slidable in a generally arcuate groove 80 having endpoints defined by two spaced-apart fasteners 82. Opposing endpoints of the groove 80 define the range of motion of the mode switch 64. A portion of a lower half 84 of the mode switch 64 engages a projection 88 (FIG. 11) of a carrier or harness 86 (FIGS. 4, 9 and 11-14), which generally surrounds and supports an upper portion of the arm 34. A rear end of the carrier 86 is preferably rotatably mounted to a portion of the main body assembly 14 proximate the rear end 22 thereof. A biasing member 96 (FIGS. 12-14), such as a spring, preferably biases the carrier 86 to a lower position, which, in turn allows the arm 86 to move to or rest in the lowered position (FIG. 9).

When the mode switch 64 is in the classic mode (FIGS. 3 and 10), the mode switch 64 raises a front end of the carrier 86, which in turn raises the arm 34 away from the bottom side 26 of the main body assembly 14 (see FIG. 8). However, when the mode switch 64 is in the magic mode (FIGS. 2 and 2A), the lower half 84 of the mode switch 64 is moved towards the bottom side 26 of the main body assembly 14 and lowers the front end of the carrier 86 and the arm 34 such that both move toward the bottom side 26 of the main body assembly 14 (see FIG. 9). When the arm 34 is in the lowered position, the magnet 36 of the arm 34 is sufficiently close to the track support surface to generate a sufficiently strong attractive force when the magnet 42 of the at least one track segment 12 is in the vicinity thereof to magnetically secure the track segment 12 to the arm 34. The attractive force is capable of pulling and/or moving at least an end portion of the at least one track segment 12 up and off of the track support surface and toward the bottom side 26 of the main body assembly 14 and into the slot 30.

Figure 11:
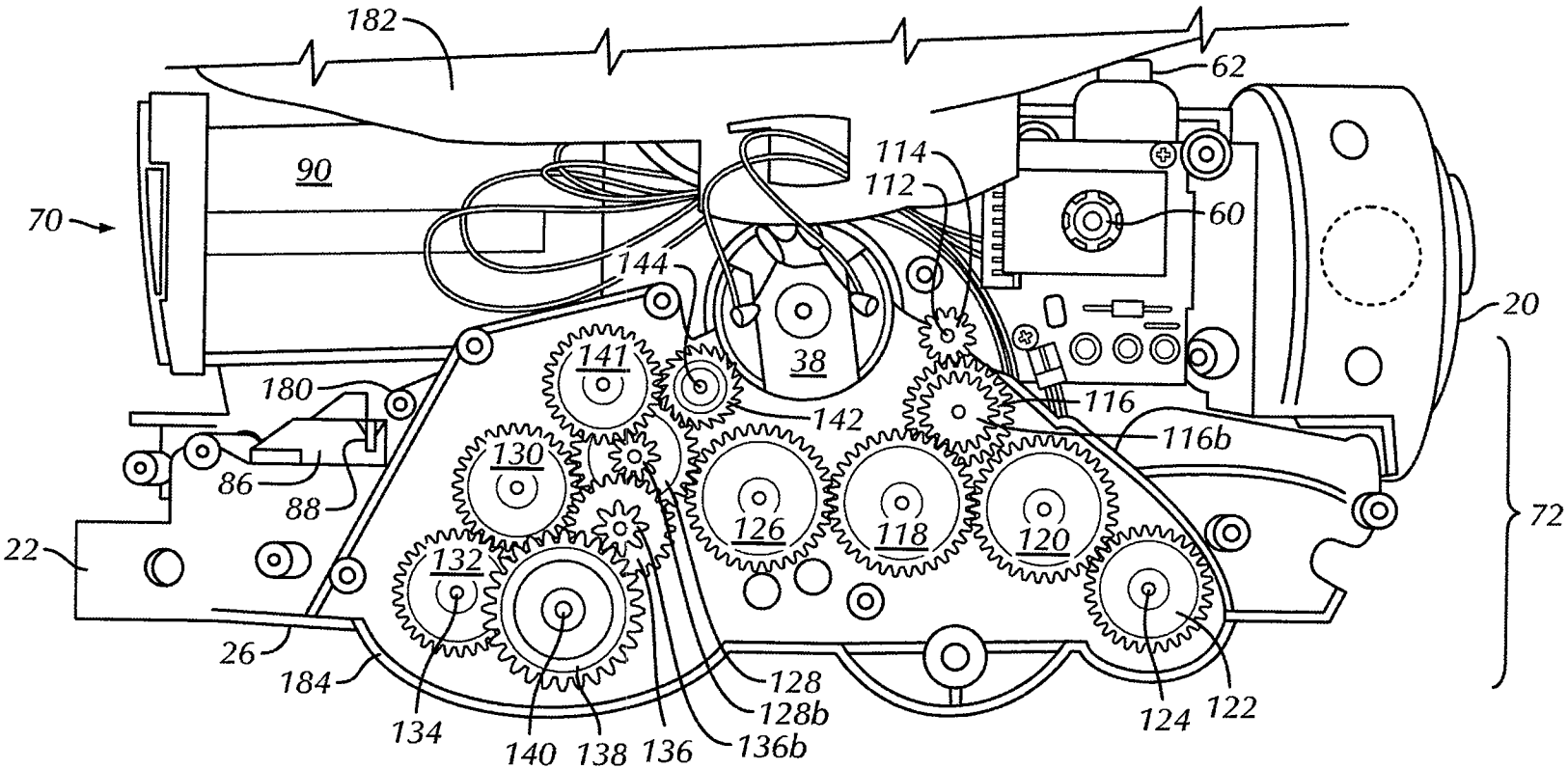
FIG. 11 is an elevation view of another portion of the chassis of the toy vehicle shown in the prior figures, which faces the portion of the chassis shown in FIG. 10.
Figure 14:
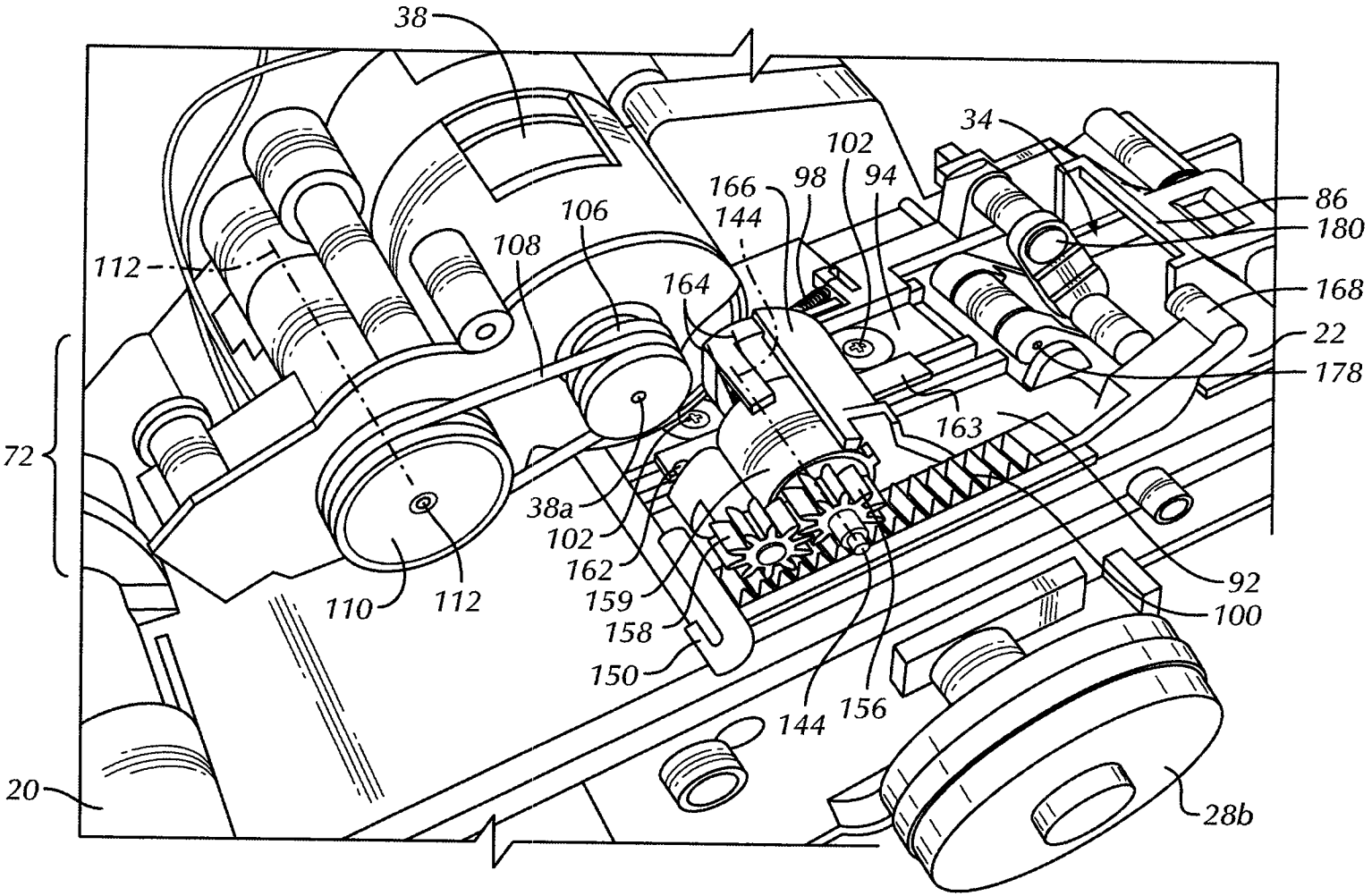
FIG. 14 is a top front left side perspective view of the toy vehicle shown in the previous figures, with outer shell portions of the toy vehicle body removed for clarity and with the pivotable arm of the toy vehicle shown in the lowered position.

Referring to FIGS. 12-14, interior ends of the arm 34 are preferably pivotably attached to each of two slidable members or plates 92, 94 that are supported within the main body assembly 14 above the top surface 13*a* of the slot 30. Specifically, the toy vehicle 10 preferably includes a rack plate 92 and a slide plate 94 atop the rack plate 92, each of which is movable or slidable in a direction generally parallel with the longitudinal axis of the toy vehicle 10 and is movably or slidable with respect to each other and with respect to the main body assembly 14. The interior end of the inner portion 170 of the arm 34 is preferably directly pivotally attached a rear end portion of the slide plate 94 by a generally horizontally-extending pin or shaft 178 (FIGS. 12-14). Likewise, the interior end of the outer portion 172 of the arm 34 is preferably directly pivotally attached to a rear end portion of the rack plate 92 by a generally horizontally-extending pin or shaft 180 (FIGS. 11-14). The pivot (shaft 180) of the outer portion 172 of the arm 34 is displaced from the pivot (shaft 178) of the inner portion 170 of the arm 34, preferably above and behind the pivot (shaft 178) of the inner portion 170 of the arm 34 (when viewing the toy vehicle 10 from the side), so that the inner portion 172 of the arm 34 can slide down the groove or channel defined by the outer portion 172 of the arm 34 and consequently move the slide plate 94 rearward on the rack plate 92, as described below.

A bottom surface of the rack plate 92 is preferably in facing slide engagement with a generally flat and smooth surface of the main body assembly 14 directly above the top surface 30*a* of the slot 30. A bottom surface of the slide plate 94 is preferably in facing slide engagement with a portion of a top surface of the rack plate 92. As seen in FIGS. 12 and 14, a biasing member 98, such as a coil spring, preferably directly attaches a portion of the slide plate 94 to the rack plate 92 and biases the slide plate 94 toward a front end of the rack plate 92. Further, at least one screw 102 preferably extends upwardly from the top surface of the rack plate 92 and preferably extends through at least one slot or groove 104 of the slide plate 94 to secure the plates 92, 94 together and to limit the range of motion of the slide plate 94 with respect to the rack plate 92. However, as seen in FIG. 14, in the preferred embodiment two spaced apart pins 102 are received in two spaced-apart grooves 104 of the slide plate 94 to assure the plates 92, 94 remaining operably parallel. As seen in FIG. 14, the top surface of the rack plate 92 preferably includes a generally linear rack segment 100 proximate the left lateral side 18 of the main body assembly 14.

Referring to FIGS. 11-14, the motor 38 is preferably supported from the main body assembly 14 and is operatively coupled with at least one of the pair of wheels 28*a*, 28*b*, 40*a*, 40*b*, the at least one roller 32, and the arm 34. In the preferred embodiment, the motor 38 rotates at least one of the pair of wheels 28*a*, 28*b*, 40*a*, 40*b* to propel the toy vehicle 10 in a forward direction over the at least one track segment 12. Further, the motor 38 preferably rotates the at least one roller 32 to propel the at least one track segment 12 through the main body assembly 14 along the slot 30. In addition, the motor 38 selectively causes the arm 34 to move toward the front end 20 of the main body assembly 14. In the preferred embodiment, the motor 38 is mounted above the slot 30 and is generally centrally located within the toy vehicle 10 along the longitudinal axis thereof.

In the preferred embodiment, to effectuate rotation of the driven wheels 28*a*, 28*b*, the rollers 32 and the arm 34, the toy vehicle 10 preferably includes a gear reduction system 72 (portions shown in FIGS. 11 and 14), which reduces the speed and increases the torque at which the motor 38 rotates the driven wheels 28*a*, 28*b*, the rollers 32 and the arm 34. Specifically, as seen in FIG. 14, a drive shaft 38*a* of the motor 38, which preferably extends toward the left lateral side 18 of the main body assembly 14, preferably rotatively engages a first pulley 106. A belt 108 surrounds both the first pulley 106 and a second pulley 110 spaced therefrom. The second pulley 110, which preferably has a larger diameter than the first pulley 106, is fixedly attached to a second belt shaft 112 that extends generally parallel to a longitudinal axis of the motor 38 defined by the drive shaft 38*a* and is spaced therefrom preferably toward the front end 20 of the main body assembly 14.

As seen in FIG. 11, an end of the second belt shaft 112 opposite the second pulley 110 preferably includes a pinion 114 proximate the right lateral side 16 of the main body assembly 14. The pinion 114 preferably rotatively engages a first drive gear 116. A smaller spur 116*b* of the first drive gear 116 is rotatively fixed thereto. The smaller spur 116*b* preferably rotatively engages a second drive gear 118 located generally below the smaller spur 116*b*. A first or front end side of the second drive gear 118 rotatively engages a first roller gear 120, which, in turn, rotatively engages a second roller gear 122. The second roller gear 122 is fixedly engaged with the front roller 32*a* by a shaft 124. Thus, rotation of the second roller gear 122 in a clockwise direction (when viewing the toy vehicle 10 from the right side—FIG. 11) rotates the front roller 32*a* in a clockwise direction (when viewing the toy vehicle 10 from the right side—FIG. 11).

Referring again to FIG. 11, a second or rear end side of the second drive gear 118 preferably rotatively engages a third drive gear 126, which, in turn, preferably rotatively engages a fourth drive gear 128. The fourth drive gear 128 preferably rotatively engages a third roller gear 130, which, in turn, preferably rotatively engages a fourth roller gear 132. The fourth roller gear 132 is fixedly engaged to the rear roller 32*b* by a shaft 134. Thus, rotation of the fourth roller gear 132 in a clockwise direction (when viewing the toy vehicle 10 from the right side—FIG. 11) rotates the rear roller 32*b* in a clockwise direction (when viewing the toy vehicle 10 from the right side—FIG. 11).

Further, the fourth drive gear 128 preferably includes a smaller spur 128*b* rotatively fixed thereto. The smaller spur 128*b* preferably rotatively engages a first wheel gear 136, which includes a smaller spur 136*b* rotatively fixed thereto. A first or lower surface of the smaller spur 128*b* preferably rotatively engages a second wheel gear 138. The second wheel gear 138 is preferably fixed to a wheel shaft 140 that extends lateral across the main body assembly 14. In the preferred embodiment, each driven wheel 28*a*, 28*b* is fixedly attached to the wheel shaft 140, such that rotation of the wheel shaft 140 in a clockwise direction (when viewing the toy vehicle 10 from the right side—FIG. 11) by the second wheel gear 138 rotates each of the driven wheels 28*a*, 28*b* in a clockwise direction (when viewing the toy vehicle 10 from the right side—FIG. 11), thus providing a means to propel the toy vehicle 10. It is preferred that at least some of the above-identified gears of the gear reduction system 72 that are proximate the right lateral side 16 of the main body assembly 14 are generally surrounded by a perimeter wall 184 that extends generally perpendicular to the right lateral side 16. Preferably, a face plate 182 removably engages at least a portion of the perimeter wall 184, such as by one or more screws (none shown), to generally enclose and/or protect certain gears of the gear reduction system 72.

Furthermore, a second or upper surface of the smaller spur 128*b* of the fourth drive gear 128 preferably rotatively engages a first arm gear 141. The first arm gear 141 preferably rotatively engages a second arm gear 142, which is fixedly engaged with a shaft 144 (see FIGS. 11-14). The shaft 144 preferably extends generally parallel to a longitudinal axis of the motor 38 defined by the drive shaft 38*a* and is spaced therefrom. The shaft 144 preferably extends toward the left lateral side 18 of the main body assembly 14. It is understood by those skilled in the art that the toy vehicle 10 is not limited to the specific arrangement of the gear reduction system 72, as described above. For example, the motor 38 may be positioned in a variety of orientations and/or locations within the toy vehicle 10. Further, the gear reduction system 72 may include more or fewer gears arranged in any one of a plurality of configurations depending, in part, on the speed of rotation of the motor 38.

Referring now to FIGS. 12 and 13, it is preferred that a cover plate 146 surrounds and/or covers at least a portion of the rack plate 92, the first pulley 106, the belt 108 and the second belt pulley 110. The cover plate 146 is preferably fixedly attached to a portion of the left lateral side 18 of the main body assembly 14. A first or front end of a biasing member 148, such as a tension coil spring, preferably surrounds a projection or hook 150 (FIGS. 12-14) that extends outwardly from a front end of the rack plate 92. The projection 150 preferably extends through an elongated slot 152 (FIG. 12) of the cover plate 146. An opposite second or rear end of the biasing member 148 preferably surrounds or otherwise engages a pin or screw 154 on the cover plate 146. Thus, in operation, the biasing member 148 urges the rack plate 92 toward the rear end 22 of the main body assembly 14.

Referring to FIGS. 12-14, an end of the shaft 144 of the second arm gear 142 proximate the left lateral side 18 of the main body assembly 14 is preferably fixedly attached to a third arm gear 156. The third arm gear 156 preferably rotatively engages a pinion gear 158 (FIGS. 14-14B), which is sized, shaped and located to selectively engage the rack segment 100 of the rack plate 92, as described in detail below. The pinion gear 158 is rotatably supported by a housing 159, which is itself rotatably attached to the shaft 144 of the second arm gear 142. As seen in FIGS. 12-14B, a positioning member 166 is also rotatably attached to the shaft 144 so as to partially surround and/or cover the housing 159. A tube or shaft 160 preferably surrounds a portion of the shaft 144 not covered by the positioning member 166 and/or housing 159. A biasing member 164 (FIGS. 12-14B), such as a torsion spring, preferably surrounds a portion of the shaft 144 and preferably rotatably aligns the housing 159 and the positioning member 166. Specifically, torsion spring 164 is preferably made of spring wire bent to form a closed loop at one end fitted over shaft 144 and two arms formed by the free ends of the wire extending away from opposite sides of the closed loop generally parallel to one another. The two wire ends of the biasing member 164 extend between the housing 159 and positioning member 166 around overlapping tongues extending from each.

The normal counter clockwise rotation of shaft 144 and third arm gear 156 creates a drag torque which rotates the positioning member 166, housing 159 and pinion gear 158 downwardly in a counter-clockwise direction about shaft 144 when viewing the toy vehicle from the left side (FIG. 14). Further, a pin 162 (FIG. 14) preferably extends from a side of the housing 159 generally opposite to, but radially displaced from, the third arm gear 156 and pinion gear 158. In operation, when the arm 34 is in the raised position (FIG. 8) or when in the lowered position (FIG. 9) and the magnet 36 of the arm 34 is a sufficient distance away from the magnet 42 of the at least one straight track segment 12*a* such that no attractive force (or only a negligible attractive force) exists between the two magnets 36, 42, the slide plate 94 is biased forward on the rack plate 92 such that an end of the pin 162 of the housing 159 generally opposite the pinion gear 158 rests on the slide plate 94. More particularly, pin 162 rests on the top surface of a ledge or shelf 163 (FIGS. 12, 14 and 14B) preferably extending outwardly from a left side of the slide plate 94 and above and laterally overlapping at least a portion of the right side of the rack plate 92. When the arm 34 is in the lowered position (FIG. 9) and the magnet 36 of the arm 34 is within a sufficient distance to the magnet 42 of the at least one straight track segment 12*a* such that a sufficient and predetermined attractive force exists between the two magnets 36, 42, the arm 34 and specifically at least the inner portion 170 of the arm 34 is pulled slightly in a direction away from the front end 20 of the main body assembly 14 by the inertia of the at least one straight track segment 12*a*. The preferably slight rearward movement of the inner portion 170 of the arm 34 with respect to the outer portion 172 and the main body assembly 14 moves the slide plate 94, and thus the ledge 163 slightly rearward with respect to the rack plate 92 and the main body assembly 14. Rearward movement of the ledge 163 allows the pin 162 to pass over a front end of the ledge 163, and drop into a horizontal slot defined by the ledge 163 and underlying edge of rack plate 92 (see FIG. 14A, for example). This, in turn, causes the pinion gear 158 to drop or move downwardly until it engages the rack segment 100 of the rack plate 92.

Figure 14A:
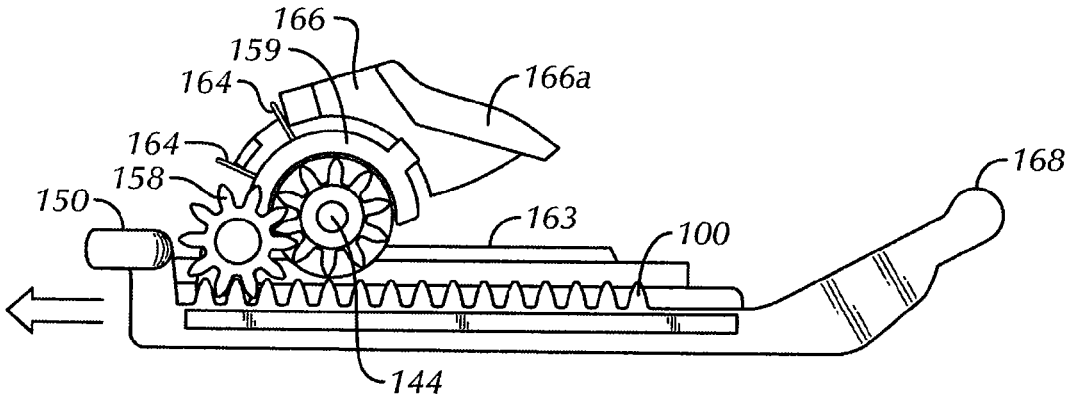
FIG. 14A is a magnified side elevation view of a portion of the toy vehicle in a first position, with certain structure of the toy vehicle removed for clarity.
Figure 14B:
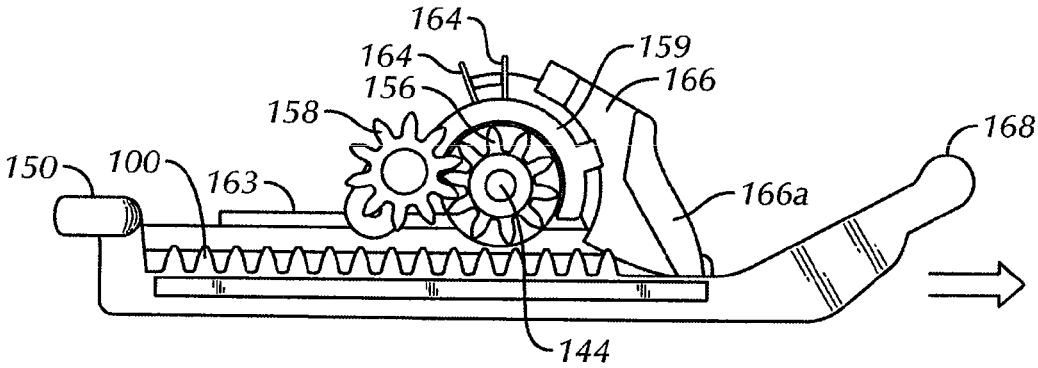
FIG. 14B is a magnified side elevation view of the portion of the toy vehicle shown in FIG. 14A in a second position.

Once the pinion gear 158 engages the rack segment 100, rotation of the pinion gear 158 causes the rack segment 100, and thus the rack plate 92 to move toward the front end 20 of the main body assembly 14 (direction of unnumbered arrow in FIG. 14A). Movement of the rack plate 92 causes the slide plate 94, and thus the ledge 163 to move toward the front end 20 of the main body assembly 14. In this configuration, at least an outer end of the pin 162 passes beneath the ledge 163, which thereby maintains constant engagement between the pinion gear 158 and the rack segment 100. Further, movement of the rack plate 92 and the slide plate 94 preferably causes the arm 34, which is temporarily attached to the at least one straight track segment 12*a*, to move toward the front end 20 of the main body assembly 14. The front end 44*a* of the at least one straight track segment 12*a* is preferably moved sufficiently forward with respect to the main body assembly 14 such that a bottom surface 15 of the at least one track straight segment 12*a* engages the provided mean for moving, i.e., at least a top portion of the rear roller 32*b* in this embodiment, causing the at least one straight track segment 12*a* to begin to pass through the slot 30. As the front end 44*a* of the at least one straight track segment 12*a* reaches the front roller 32*a*, the front roller 32*a* feeds/propels the track segment 12*a* forward and out of the toy vehicle 10 through the front end of the slot 30 (FIG. 6).

A length of the ledge 163, as measured along the longitudinal axis of the toy vehicle 10, is preferably less than that of the rack segment 100. Therefore, when the pinion gear 158 reaches or approaches a rear end of the rack segment 100, the end of the pin 162 passes a rear end of the ledge 163. Thus, in this configuration, the ledge 163 no longer maintains contact between the pinion gear 158 and the rack segment 100. Further, a rear end 166*a* (FIGS. 12-14) of the positioning member 166 preferably contacts an upwardly extending section 168 of the rack plate 64 and/or any other structure in the vicinity thereof, causing the positioning member 166 to bias through bias member 164, the housing 169 and thus the pin 162 and the pinion gear 158 in a clockwise direction about shaft 144, upwardly and out of contact with the rack segment 100. Once the pinion gear 158 no longer engages the rack segment 100 and the pin 162 is free from the downward constraint of the ledge 163, the biasing member 148 of the cover plate 146 urges the rack plate 92, and thus the slide plate 94 and the arm 34 back toward the rear end 22 of the main body assembly 14 (direction of unnumbered arrow in FIG. 14B) to a position to repeat the above cycle. In operation, the toy vehicle 10 is capable of consecutively relocating two straight track segments 12*a* such that the toy vehicle 10 appears to be riding on one of the straight track segments 12*a* at all times.

Preferably, the toy vehicle 10 is configured to operate with at least a pair of track segments 12, lifting a first track segment 12 that has been passed over, passing the first track segment 12 through the toy vehicle 10 and depositing the first track segment 12 at the front end of a second track segment 12, over which the toy vehicle 10 is passing, preferably with facing male and female connectors 45, 47 engaging one another, and repeating the process with the second segment 12. However, it is understood by those skilled in the art that the toy vehicle 10 may include only a single roller 32, as described above, or more than two rollers 32, or other rotating or reciprocating elements, to propel the at least one straight track segment 12*a* through the slot 30. It should be further understood that the one or more rollers 32 may have a friction generating surface to frictionally engage the track segment(s) 12 or a toothed surface (i.e., a spur gear) to engage a rack of teeth provided along the bottom surface 15 of the track segment 12 (none depicted). It should also be appreciated that two or more rollers 32 may drivingly support a conveyor that can engage the track segment(s) 12 frictionally, mechanically (e.g., by teeth) and/or magnetically to move the track segment(s) 12 through the slot 30. Again, these are but a few of the means possible for moving a track segment 12 entirely through the main body assembly 14 along the slot 30.

A method of operating the toy vehicle 10 preferably includes propelling the toy vehicle 10 over at least one track segment 12, picking up the at least one track segment 12 at one end 20, 22 of the toy vehicle 10, passing the at least one track segment 12 longitudinally through the toy vehicle 10, and relaying the at least one track segment 12 at an opposite end 22, 20 of the toy vehicle 10. More specifically, a method of operating the toy vehicle 10 preferably includes propelling the toy vehicle 10 in a first direction over the at least one track segment 12, moving the arm 34 to engage at least a portion (e.g., end 44*a*, 46*a*) of the at least one track segment 12, moving the combined arm 32 and at least one track segment 12 toward one end 20, 22 of the toy vehicle 10, raising at least the portion of the at least one track segment 12 onto at least a portion of the at least one roller 32, propelling the at least one track segment 12 from the one end 20, 22 of the main body assembly 14 to and out of another end 20, 22 of the main body assembly 14, and propelling the toy vehicle 10 over the at least one track segment 12.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

We claim:

1. A toy vehicle comprising:

a main body assembly having opposing right and left lateral sides, opposing front and rear ends, and opposing top and bottom sides extending between the lateral sides and the ends, the combined opposing right and left lateral sides and opposing top and bottom sides of the main body assembly defining a slot that extends front to rear entirely through the toy vehicle; and means for lifting at least one track segment from a level below the main body assembly up and into the slot and moving the at least one track segment entirely through the main body assembly along the slot from one end of the toy vehicle to the opposing end of the toy vehicle.

2. The toy vehicle according to claim 1 wherein the toy vehicle is operable in a first operating configuration in which the toy vehicle moves in a first direction while picking up a general linear track segment and propelling the generally linear track segment though the main body assembly and a second operating configuration in which the toy vehicle moves in the first direction on or over a generally arcuate track segment.

3. The toy vehicle according to claim 1 wherein the means for lifting and moving comprises:

at least one roller located within the main body assembly extending axially in a direction generally between the lateral sides of the main body assembly and exposed in the slot so as to receive an end of the at least one track segment lifted into the slot.

4. The toy vehicle according to claim 1 wherein the means for lifting and moving comprises:

an arm movably supported from the main body assembly so as to engage an end of the at least one track segment proximal the rear end of the toy vehicle and lift the end of the at least one track segment into the slot of the main body assembly.

5. The toy vehicle according to claim 4 wherein the arm is located proximate the rear end of the main body assembly and includes a magnet therein.

6. The toy vehicle according to claim 4 wherein the means for lifting and moving further comprises:

at least one roller located within the main body assembly extending axially in a direction generally between the lateral sides of the main body assembly so as to receive the end of the at least one track segment lifted into the slot by the arm.

7. The toy vehicle according to claim 6 wherein the arm is mechanically interconnected with the at least one roller for simultaneous movement of the arm with rotation of the roller.

8. The toy vehicle according to claim 6 further comprising another roller located within the main body assembly, each roller extending axially in a direction generally between the lateral sides of the main body assembly, wherein one of the rollers is proximate the front end of the main body assembly and the other roller is proximate the rear end of the main body assembly.

9. The toy vehicle according to claim 6 further comprising:

a pair of wheels supported for rotation from the main body assembly proximal the opposing right and left lateral sides of the main body assembly, the pair of wheels beings sized and shaped to rotate adjacent to or across a top surface of the at least one track segment while extending below the main body assembly.

10. The toy vehicle according to claim 9 wherein the pair of wheels, the arm and the at least one roller are operatively coupled together for simultaneous operation.

11. The toy vehicle of claim 9 further comprising:

a motor operatively coupled with at least one of the pair of wheels, the at least one roller and the arm so as to rotate at least one of the pair of wheels to propel the toy vehicle in a forward direction over the at least one track segment, selectively move the arm to engage and lift that at least one track segment into the main body assembly and rotate the at least one roller to propel the at least one track segment through the slot.

12. The toy vehicle according to claim 11 further comprising a gear reduction system that operatively connects the motor to the pair of wheels, the at least one roller and the arm.

13. The toy vehicle according to claim 11 further comprising a second pair of support wheels supported for rotation from the main body assembly proximal the opposing right and left lateral sides, the second pair of support wheels being sized and shaped to rotate adjacent to or across a top surface of the at least one of track segment while extending below the main body assembly and the slot.

14. A method of operating toy vehicle according to claim 6 comprising the ordered steps of:

a) propelling the toy vehicle according to claim 6 in a forward direction over the at least one track segment;

b) moving the arm so as to directly contact and engage at least an end of the at least one track segment now located behind the toy vehicle;

c) moving the at least one track segment toward the rear end of the toy vehicle with the arm;

d) raising at least the engaged end of the at least one track segment onto at least a portion of the at least one roller;

e) with use of the roller, propelling the at least one track segment from the rear end of the main body assembly to and through the front end of the main body assembly; and f) propelling the toy vehicle in a forward direction over the at least one track segment now located in front of the toy vehicle.

15. A method of operating a toy vehicle, the method comprising the ordered steps of:

providing a toy vehicle having a main body assembly having a first end, an opposing second end and a slot that extends entirely therethrough between the first and second ends, and a pair of wheels supported for rotation from the main body assembly so as to extend beneath the main body assembly and the slot, the toy further having an arm movably supported from the main body assembly and operatively coupled with at least one of the pair of wheels;

propelling the toy vehicle in a first direction over at least one track segment on the pair of wheels;

picking up at least an end of the at least one track segment at one end of the toy vehicle by moving the arm to engage the end of the at least one track segment at the second end of the main body assembly and raising at least the end of the at least one track segment with the arm into the slot;

passing the at least one track segment longitudinally through the toy vehicle from the one end to an opposite end of the toy vehicle; and relaying the at least one track segment at the opposite end of the toy vehicle.

16. The method according to claim 15 wherein the toy vehicle further includes at least one track segment propulsion element and the passing step further comprises propelling the at least one track segment through the slot from the second end of the main body assembly to and out of the first end of the main body assembly using at least the one track segment propulsion element.

17. The toy vehicle according to claim 5 wherein the arm has a distal end face and is mounted to the main body assembly to pivot the distal end face up and down so as to directly contact and lift the at least one track section with the distal end face, and wherein the magnet is located in the distal end face to engage the track section contacted by the arm.

18. The toy vehicle of claim 6 wherein the at least one roller is located in a bottom side of the slot to underlie and propel the at least one track section passed entirely through the main body along the slot.

* * * * *